US006374746B1

(12) United States Patent
Fiske

(10) Patent No.: US 6,374,746 B1
(45) Date of Patent: Apr. 23, 2002

(54) MAGNETIC LEVITATION TRANSPORTATION SYSTEM AND METHOD

(76) Inventor: Orlo James Fiske, 122 Benicia Way, Oxnard, CA (US) 93033

( * ) Notice: Subject to any disclaimer, the term of this patent is extended or adjusted under 35 U.S.C. 154(b) by 0 days.

(21) Appl. No.: 09/499,604

(22) Filed: Feb. 7, 2000

Related U.S. Application Data

(60) Provisional application No. 60/140,165, filed on Jun. 21, 1999.

(51) Int. Cl.[7] ..... B61B 13/00

(52) U.S. Cl. ..... 104/138.1; 104/27; 104/28; 104/139; 104/282; 104/283

(58) Field of Search ..... 104/290, 292, 104/288, 130.2, 281, 282, 283, 138.1, 139, 138.2, 284; 198/619

(56) References Cited

U.S. PATENT DOCUMENTS

| | | | | | |
|---|---|---|---|---|---|
| 2,488,287 | A | * | 11/1949 | Goddard | 104/138.2 |
| 3,724,690 | A | * | 4/1973 | Bates | 214/52 C |
| 3,724,691 | A | * | 4/1973 | Carstens et al. | 214/52 C |
| 3,738,281 | A | | 6/1973 | Waidelich | |
| 3,763,788 | A | * | 10/1973 | Pougue | 104/130 |
| 3,951,074 | A | * | 4/1976 | Cooper | 104/148 MS |
| 4,015,540 | A | * | 4/1977 | Roxberry | 104/148 LM |
| 4,023,500 | A | * | 5/1977 | Diggs | 104/138 R |
| 4,075,948 | A | * | 2/1978 | Minovitch | 104/138 R |
| 4,795,113 | A | * | 1/1989 | Minovitch | 244/63 |
| 5,146,853 | A | * | 9/1992 | Suppes | 104/138.2 |
| 5,241,912 | A | * | 9/1993 | Oshima et al. | 104/282 |
| 5,253,591 | A | | 10/1993 | Rote et al. | |
| 5,253,592 | A | | 10/1993 | Coffey | |
| 5,270,593 | A | | 12/1993 | Levi et al. | |
| 5,282,424 | A | | 2/1994 | O'Neill | |
| 5,388,527 | A | | 2/1995 | Thornton | |
| 5,433,155 | A | * | 7/1995 | O'Neill et al. | 104/282 |

(List continued on next page.)

OTHER PUBLICATIONS

Heller, Arnie, "A New Approach for Magnetically Levitating Trains—and Rockets", Lawrence Livermore National Laboratory Science & Technology Review, Jun. 1998.

Gourley, Scott R., "Track to the Future", Popular Mechanics, May 1998.

Zhao, Yiyuan and Lundgren, Thomas S., "Characteristics of a Freight Pipeline Transportation System", International Conference on Personal Rapid Transit and Other Emerging Transportation Technologies, Nov., 1996.

Suppes, Galen J., "A Perspective on Maglev Transit and Introduction of the PRT Maglev", Transportation Research Record, No. 1496, 1995, pp103–111.

Vance, Lawrence and Mills, Milton K., "Tube Freight Transportation", Public Roads On–Line, Autumn 1994.

Society for Automotive Engineers, "Magnetic Levitation Technology for Advanced Transit Systems", SP–792, 1989.

Post, Richard F., "Maglev: A New Approach", Scientific America, Jan. 2000.

Kolm, Henry H. and Thornton, Richard D., "Electromagnetic Flight", Scientific American, Oct. 1973.

Reitz, John R., "Forces on Moving Magnets due to Eddy Currents", Journal of Applied Physics, Apr. 1970.

*Primary Examiner*—S. Joseph Morano
*Assistant Examiner*—Frantz F. Jules
(74) *Attorney, Agent, or Firm*—Anna M. Vradenburgh; Gregory A. Piccionelli

(57) ABSTRACT

A ground-based capsule pipeline with greatly improved speed, energy efficiency, and cost for transportation of freight and/or people. Passive magnetic levitation is used to suspend inert, rugged capsules within an air-evacuated pipeline, where they are propelled by a linear motor. Permanent magnet pole arrays incorporated in the capsules interact with inductively-enhanced conductive loops on the interior of the pipeline to produce a low "take-off" speed, high lift, and a high lift-drag ratio.

36 Claims, 12 Drawing Sheets

U.S. PATENT DOCUMENTS 5,460,098 A 10/1995 Jackson et al.
5,517,924 A 5/1996 He et al.
5,566,620 A 10/1996 Siewert
5,641,054 A * 6/1997 Mori et al. ..... 198/619
5,652,472 A 7/1997 Tozoni
5,653,175 A * 8/1997 Milligan ..... 104/138.1
5,722,326 A 3/1998 Post
5,865,123 A 2/1999 Powell et al.
5,950,543 A * 9/1999 Oster ..... 104/138.1
6,044,770 A * 4/2000 Davey et al. ..... 104/282

* cited by examiner

MAGNETIC LEVITATION TRANSPORTATION SYSTEM AND METHOD

RELATED APPLICATIONS

The present disclosure relates to U.S. Provisional Patent Application No. 60/140,165, filed Jun. 21, 1999, which is incorporated herein by reference.

FIELD OF THE INVENTION

The present invention relates, generally, to ground-based transport systems and processes, and in particular embodiments, to systems and processes utilizing transportation capsules that are magnetically levitated and electromagnetically propelled.

BACKGROUND OF THE INVENTION

Long-distance communication technologies such as satellite data links and fiber-optics have made it faster, easier, and less expensive to move information throughout the world. Modern developments in communication technologies, for example, in such areas as teleconferencing, telecommuting, and Internet on-line shopping have resulted in significant improvements in the manner in which information is communicated over distances. Indeed, modern computer or telephone users may hold teleconferences, send text or image information by facsimile, e-mail or other network connection, send purchase orders for goods or services and conduct many other communications activities, without having to leave home or office.

However, in many contexts, communication of only information, for example, video, text, audio, or the like, between two locations is not sufficient. Rather, a material object must be transported between the locations. Thus, for example, while network and Internet communication technologies have significantly improved the ability and ease by which a user may send a purchase order or otherwise request a material item across distances, so far, no one has found a way to ship material items over the Internet. Typically, material items are transported by truck, railroad, airline, ship, or a combination of such modes of transportation. Each of these modes of transportation has an inherent delay, cost, safety and environmental impact.

As the popularity of computer communications, telecommunications and on-line ordering and shopping increases, the need for fast, low-cost transportation for light freight material items, such as, parcels, parts, manufactured items, printed documents, food items, and all types of remotely purchased goods is higher than ever before, and growing rapidly. This comes at a time of increasing environmental concerns, for example, highway congestion, further compounding the problem, and dense traffic does more than just delay shipping and add to costs. Studies have shown that in 1997 as many as 133,000 people were injured and over 5,300 killed in accidents involving commercial trucks in the United States alone. In many other countries accident rates are higher.

Various methods to improve the transportation infrastructure have been proposed. Designs for magnetically levitated trains have received much attention, and prototype systems have been developed, but have proven to be very expensive. Construction costs may be in the range from $20 million to $60 million or more per mile of railway, not including costs associated with obtaining right-of-way. Automated capsule systems of various types utilizing pneumatic or electromagnetic propulsion to move freight capsules at relatively low speed have also been proposed, and a few have even been built. None have proven sufficiently advantageous for widespread acceptance.

When fast transport is required, light freight is currently shipped by cargo jet. A welldesigned logistical system can make such transport quite rapid, but it will never be inexpensive for two fundamental reasons: (1) aircraft and airports are very expensive to build, operate, and maintain, and (2) air freight is the most energy-intensive transportation technology in use today.

SUMMARY OF THE DISCLOSURE

The preferred embodiment of the transportation systems, methods and apparatuses described herein employ a ground-based capsule pipeline with greatly improved speed, energy efficiency, and cost for transportation of freight and/or people. In preferred embodiments, passive magnetic levitation is used to suspend inert, rugged capsules within an air-evacuated pipeline, where they are propelled by a linear motor. Permanent magnet pole arrays incorporated in the capsules interact with inductively-enhanced conductive loops on the interior of the pipeline to produce a low "take-off" high lift, and a high lift-drag ratio. Electrodynamic drag decreases with increasing capsule speed, and with little or no air in the pipeline to produce aerodynamic drag the ultimate straight-line capsule speed is essentially unlimited.

Preferred embodiments of the design include elements which allow for unconstrained capsule bank angle during passage through turns, allowing either low or high-speed transition without subjecting the payload to significant side forces. Peak cornering speed is limited only by pipeline structural strength and capsule and payload G-force endurance in the "local vertical" direction, allowing short-radius curves in pipeline construction. Further preferred embodiments of the system accommodate capsule travel in either direction within the same pipeline. Greater payload volumes are achievable by using relatively low capsule separations or multiple capsules linked together and cargo containers compatible with standard-size shipping containers. Energy consumption is lower than any present high-volume, long distance transportation system, including rail and ship. Multiple inter-city pipelines create a redundant, fault-tolerant packet-switching network environment.

BRIEF DESCRIPTION OF THE DRAWINGS

Referring now to the drawings in which like reference numbers represent corresponding parts throughout:

FIG. 16 is a cross section of the router of FIG. 15, as a capsule passes through.

DETAILED DESCRIPTION OF THE PREFERRED EMBODIMENT

The following detailed description is of the best presently contemplated mode of implementing the invention. This description is not to be taken in a limiting sense, but is made merely for the purpose of illustrating the general principles of the invention. The scope of the invention is best defined by the appended claims.

The present invention relates, generally, to ground-based transport systems, methods and components thereof, and in particular embodiments, to such systems and methods utilizing transportation capsules that are magnetically levitated and electromagnetically propelled within a pipeline network.

Figure 1:
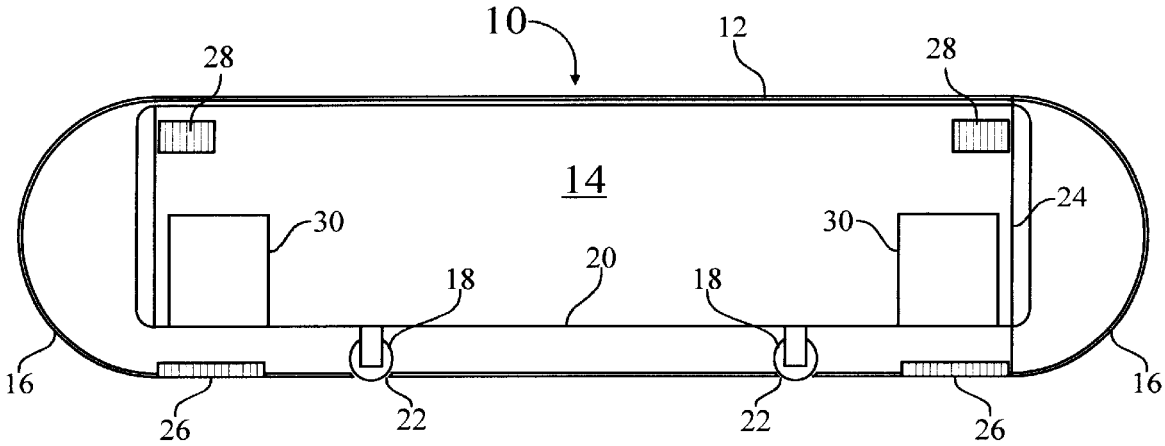
FIG. 1 is a side-cutaway view of a freight capsule according to the preferred embodiment of the invention.
Figure 2:
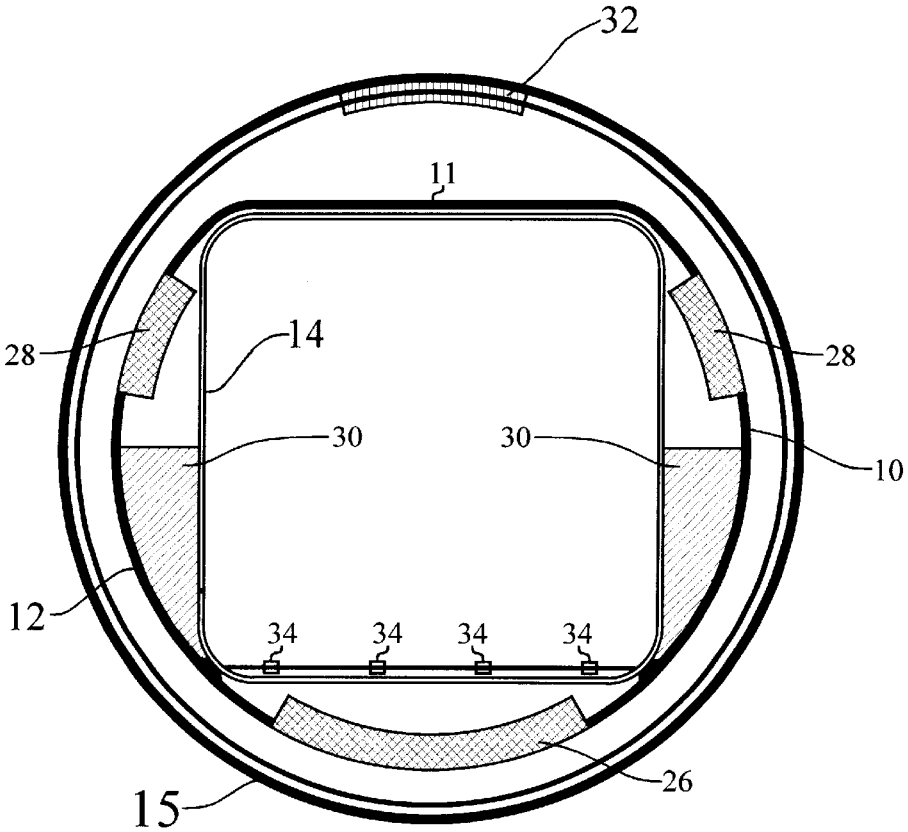
FIG. 2 is a cross section of the freight capsule of FIG. 1 and a pipeline in which it travels.

A transport capsule 10, according to the preferred embodiment of the present invention is shown in side cutaway view in FIG. 1. The capsule includes an exterior shell 12 enclosing an interior, pressurized inner walled compartment or payload bay 14. The capsule, shown in cross-section view in FIG. 2, is configured to travel within a length of pipe or pipeline 15 and, preferably, within a network of pipelines, as discussed in further detail below.

The capsule shell 12 and payload bay 14 may be made of any suitable material and structural configuration capable of supporting a pressurized interior and having suitable strength and weight characteristics to accommodate high speed transportation, as described below. For example, various metals, plastics, fiber-glass and other composite materials and structural configurations for supporting pressurized interiors at high speed travel are well known in the aeronautics industry as having such characteristics and are readily available to persons skilled in the art.

The shell 12 includes an aerodynamic shape or fairings 16 at the front and rear, respectively, to minimize aerodynamic drag when used in unevacuated or partially evacuated pipelines. Fixed wheels 18 are attached to bottom of the payload bay 14 or other suitable structure 20 beneath the payload bay, and protrude a short distance through openings 22 in the shell, for example, on the order of ¼ to ½ an inch, to support the capsule when it is outside the transport pipeline, stationary, or moving at less than take-off speed. An airtight access hatch 24 at one end of the capsule provides access to the payload bay 14. In other embodiments, access hatches may be included at both ends or on one or more of the sides, top or bottom of the capsule.

Magnet arrays 26 are mounted below the payload bay 14, at each end of the capsule 10, to provide electrodynamic lift for levitating the capsule off the wheels at a low take-off speed, for example, less than 5 kilometers per hour. In the illustrated embodiment, two magnet arrays 26 are shown. However, further embodiments may include additional magnet arrays 26 for providing electrodynamic lift. In preferred embodiments, the wheels 18 are placed between the magnet arrays 26, closer to the mid-point of the capsule 10, in order to maximize the separation between wheels 18 and the pipeline wall, as the capsule passes through curves in the pipeline. Additional, smaller magnet arrays 28 are mounted at front and rear on the left and right sides near the top of the payload bay 14, to provide lateral stability and to inhibit the upper surface of the capsule from contacting the pipeline interior. Upper and lower magnet arrays 26 and 28 may be composed of neodymium-iron-boron or aluminum, nickel, iron and cobalt alloys or other permanent magnet compositions of suitable strength and design to maintain a minimum clearance, for example, of approximately 2 inches or more, between the capsule and pipeline at normal operating speeds.

In preferred embodiments, trim tanks 30 are located inside the capsule shell 12, on the left and right sides of the payload bay, near the front and rear of the capsule. Each trim tank 30 comprises a weight mass and, preferably comprises a tank partially or entirely filled with a heavy substance, such as water, as necessary to compensate for uneven weight distribution in the payload and ensure correct balance for level flight. The use of a tank containing a liquid substance for each trim tank 30 allows automated load balancing.

For example, after the loading of a capsule, but prior to transportation, the capsule may be placed on a weighing device that compares the relative weights of, for example, four quadrants (front versus rear and left side verses right side). Hoses may be attached to fittings (not shown) on the trim tanks in the lighter quadrants, for example by robotic arms, and water may be pumped into those tanks, to equalize the weight of the four quadrants. To measure whether the center of mass of the capsule, after equalization, is sufficiently low, the capsule may be supported on a rotating frame and rotated to the left and/or right about its lengthwise axis, while measuring devices measure the restoring torque (the torque exhibited by the capsule's tendency to rotate back to its normal orientation). If the center of mass is low, like a pendulum, the restoring torque would gradually increase as the capsule is rotated away from its normal orientation. If the center of mass is high, like an inverted pendulum, the restoring torque would be negative and the capsule would have a tendency to flip over. In further embodiments, ballasts, such as one or more water tanks (not shown) may be provided, for example, underneath the payload bay, to lower the center of mass and inhibit any tendency of the capsule to flip over.

FIG. 2 is a cross-sectional view of the capsule 10, taken near one end. Each lift magnet array 26 is relatively wide, centered, and is preferably convex to conform to the pipeline's concave surface and to provide lift, stability and a self-centering capability. The stabilizer arrays 28 and trim tanks 30 on the left and right side of the capsule 10 further improve balance and the self-centering nature of the capsule design.

Preferably, the trim tanks are mounted low in the capsule shell 12, to provide a low center of mass. The stabilizer arrays 28 are essentially extensions of the levitation arrays. In other embodiments, the levitation 26 and stabilization arrays 28 may be combined into one continuous or discontinuous array partially or wholly around the inner circumference of the shell 12. The upper surface 11 of the capsule 10 is flattened to lower the center of mass, to provide adequate clearance between the capsule and the inductive load 32 mounted along the upper interior of the pipeline 15, and to reduce friction caused by residual air in the pipeline. Rollers 34 may be mounted on the floor of the payload bay 14, to allow easy loading and unloading of cargo containers.

For proper operation, payloads must be kept within the lift capabilities of the capsule, should be balanced enough to permit any unbalance to be corrected via the trim tanks, and should have a low enough center of mass to prevent the capsule from becoming top-heavy and in danger of tipping over. Ballast (not shown) may be included beneath and/or to the sides of the payload bay to further ensure a low center of mass. Thus the capsule should "float" generally upright and bank automatically when passing through pipeline curves. Shock absorbers (not shown) may be installed beneath the payload bay floor or between the payload bay 14 and the capsule shell 12 to help dampen physical shocks. Preferably, all empty spaces between the capsule shell and payload bay are filled with a filler material, such as a dense foam, to reinforce structural strength and further minimize vibration. The result is a simple, rugged, durable capsule suited for long-term use with very little maintenance. Couplers may be included at front and rear of the capsule 10, to permit multiple capsules to be connected together and controlled as a single unit for higher system payload capacity.

The payload bay 14 is pressurized to maintain a benign environment for payload and, depending on system requirements, may be sized for compatibility with standard shipping containers. For example, a full-size standard shipping container has exterior dimensions of 8 feet by 8 feet by 40 feet, and interior dimensions of 7.5 feet by 7.5 feet by 39.5 feet, and holds forty-five sub-containers, stacked 3 by 3 by 5, where each sub-container is 2.5 feet wide, 2.5 feet high, and 8 feet long. A capsule payload bay 2.5 feet wide, 2.5 feet high, and 8 feet long would permit the transfer of 45 sub-containers of about that size directly from a conventionally-shipped full-size container into 45 capsules for high speed transport. In other embodiments, the pipeline and capsule payload bay could be sized to carry a full-size (8'×8'×4O') shipping container or passenger compartment of similar size.

As discussed above, the capsule 10 is configured to travel within a pipeline 15 and, preferably, within a network of pipelines. Thus, a system, according to an embodiment of the present invention, includes one or more capsules, for example as described above, and a pipeline or network of pipelines. Other components of the pipeline system embodiments (including a suitable pipeline air evacuation subsystem for providing a vacuum within the pipeline) will become apparent from the discussion below.

The natural gas industry has installed over 275,000 miles of gas transmission pipeline in the United States alone, and thus pipeline construction is highly developed and well understood. The largest of these pipelines is 42 inches in diameter and carries gas pressurized to over 1000 pounds per square inch. Pipelines of this type presently can cost about $1 million per mile buried underground. In one embodiment, a capsule transport pipeline may be configured similar to a gas pipeline, but with structural features described below relating to electromagnetic levitation features and preferably constructed of a lighter material, since it need only support a partial vacuum, i.e. a pressure of less than one atmosphere (~14.7 pounds per square inch).

Aerodynamic drag depends upon several factors, including air pressure in the pipeline, the ratio of capsule cross-sectional area to pipeline cross-sectional area (also known as the blockage ratio), and capsule speed. In preferred embodiments, the system includes a pipeline air evacuation subsystem for providing a vacuum within the pipeline (or, at least, in a section of a pipeline network in which a capsule is to be transported). The level of vacuum utilized in a particular capsule system depends upon system requirements and economics. For example, with pipeline air pressure pumped down to 0.001 atmosphere, aerodynamic drag is lower than electrodynamic drag, even at speeds in excess of 1000 miles per hour, resulting in extremely low energy consumption requirements. This level of vacuum also provides effective thermal insulation, making the capsule especially good for transporting perishable products that must be kept refrigerated.

Figure 3:
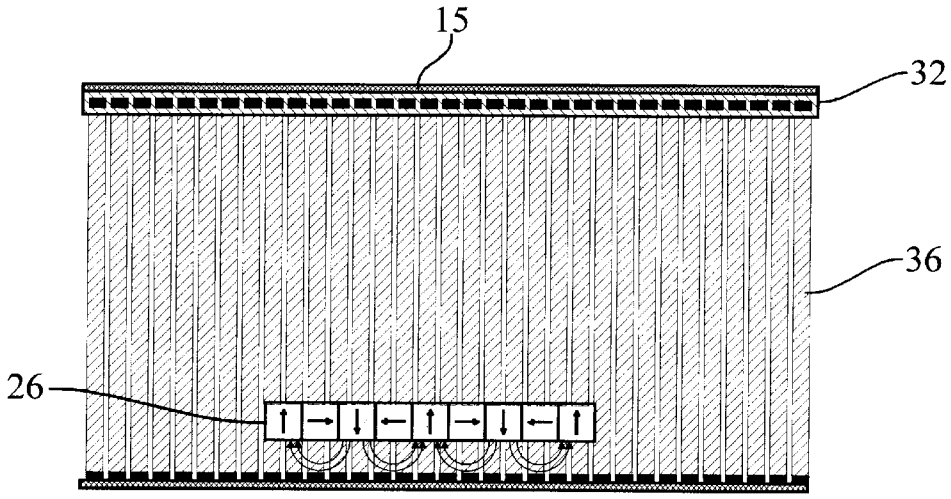
FIG. 3 is a side-cutaway view of a magnetic pole array moving through a series of conductive loops inside the pipeline.

A section of a pipeline 15 according to an embodiment of the invention is shown, in a side cut-away view, in FIG. 3. The pipeline includes a conductive structure for interacting with the magnet arrays on a moving capsule. Such conductive structure may comprise, for example, narrow loops of conductive material 36, such as aluminum or copper, which line the inside of the pipeline. The loops 36 may define a spacing of, for example, about 4 loops per inch of pipeline length.

Research has shown that lift increases and drag decreases, as the ratio of inductance to resistance in the conductive loops increases (see U.S. Pat. No. 5,733,326—Magnet Levitation System for Moving Objects, Richard F. Post). Therefore, in preferred embodiments, the loops are embedded in an inductive load 32, such as, but not limited to, high-permeability ferrite or laminated transformer iron, for a short section near the top of the pipe 15, to increase inductance without significantly increasing resistance. In other embodiments, inductive load material may be added in other sections of the loops, provided it does not cause detrimental interactions with capsule magnet arrays (see below). In still other embodiments, the conductive loops may be replaced by sheets of conductive, non-magnetic material such as aluminum or copper conforming to the inside of the pipe, or the pipe itself may be composed of such material. When multiple sheets are used, the sheets are separated by electrically insulating material. In addition, parallel slots may be etched or otherwise cut or formed into each sheet to minimize eddy currents that would increase electrodynamic drag and power consumption.

FIG. 3 also shows a magnetic pole array (such as a magnet array 26 in FIG. 1) traveling through the pipeline 15. The pole array preferably utilizes a configuration sometimes known as a Halbach array, which provides a strong magnetic field on one side (the side closest to the conductive loops) and almost no field on the opposing side. Thus the capsule payload and its contents are not subjected to high magnetic fields from the pole array.

With this configuration movement of the array past the loops induces eddy currents in the loops, which in turn produces a magnetic field that opposes the array magnetic field and produces lift. The lift climbs rapidly giving a low take-off speed and at higher speed provides up to nearly 70 pounds of lift per square inch of pole array, allowing relatively small magnet arrays 26 to support the capsule 10. For example, a capsule 10 with a maximum gross weight of 4000 pounds would require less than 2 square feet of magnetic pole array, which includes a four to one safety margin for G-force loading in turns and lift reduction due to levitation height.

Thus, the electromagnetic interaction of the conductive structure (such as loops 36) on the pipeline and the magnet arrays 26 on the capsule provides lift force for effectively floating the capsule within the pipeline, when the capsule is moving at a sufficient speed within the pipeline. Drive force to achieve and maintain a sufficient speed is preferably provided by a multi-phase linear synchronous propulsion motor, as described below. However, other embodiments may employ other suitable propulsion means.

Figure 4:
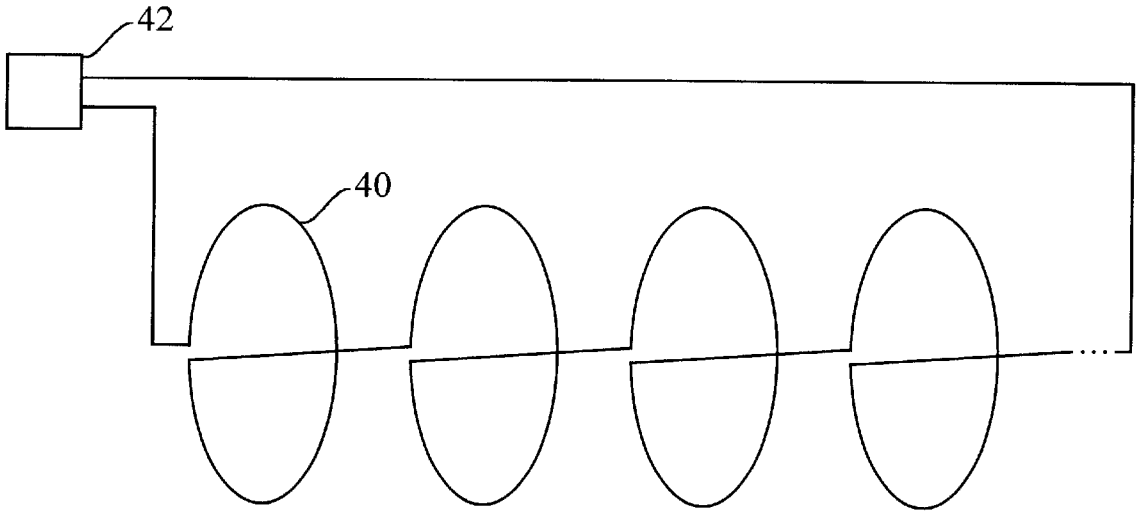
FIG. 4 depicts a stepped helical winding used as one phase of a multi-phase linear synchronous motor.

FIG. 4 shows a stepped helical winding 40 used as one phase of a multi-phase linear synchronous propulsion motor used in preferred embodiments. Several windings of this type, for example three windings for a 3-phase motor, are mounted on the inside surface of the pipeline 15. The windings are electrically insulated from the conductive loops 34. Each winding is coupled to suitable control electronics 42 for energizing (applying an electrical current to) the windings in a controlled order. When energized with electric current, timed in succession according to the position of the capsule 10 within the pipeline 15, the magnetic field produced by the windings interacts with the field produced by the pole arrays (magnet arrays 26 and 28) on the capsule to provide thrust.

Due to the symmetrical arrangement around the capsule 10 of the lift and stabilization arrays 26 and 28 (FIG. 2) and because the winding loops 36 (FIG. 3) are perpendicular to the pipeline axis, thrust is symmetrically applied to the capsule and forces the capsule directly along the pipeline axis. Thrust may be applied in either direction. The windings 40 are energized in sections along the pipeline. A section need only be energized when there is a capsule passing through it, to minimize power consumption.

Each section may be of any suitable length and, in preferred embodiments, is a mile or more in length. Alternatively, a section may be even shorter than the length of a single freight capsule, thereby providing precise control over the motion of each individual capsule. This would allow capsules to be "platooned," in that they may be propelled in close proximity to other capsules, while separate control is retained over each capsule. For example, a capsule could be propelled at higher speed than the capsule in front of it until it arrives within one or two feet of contact, then slowed to move at the same speed. When the capsules pass through a router, as described below, each capsule could be directed to any one of a plurality of routes, independent of the other capsules in the "platoon."

Thus, for example, a 4000 pound capsule with a payload moving at a speed of 300 miles per hour through a pipeline containing air at 0.001 atmosphere, for example, would require approximately 15 kilowatts of power. Assuming that the payload is 3000 pounds of the capsule weight, this equals 128 Btu's per ton-mile, about a third of the energy required for rail transport and nearly 400 times lower than for air freight. When operating at 600 miles per hour, power consumption remains about the same but consumption per ton-mile is cut in half.

In other embodiments a linear induction motor may be used in place of a linear synchronous motor. In still other embodiments where high speed is not required the linear motor may be replaced by pneumatic propulsion. In this case the capsule is constructed without aerodynamic fairings and shaped to leave little space between the capsule and the pipeline wall. Fluid or gas, such as air is pumped into the pipeline behind the capsule, to drive the capsule forward.

Figure 5:
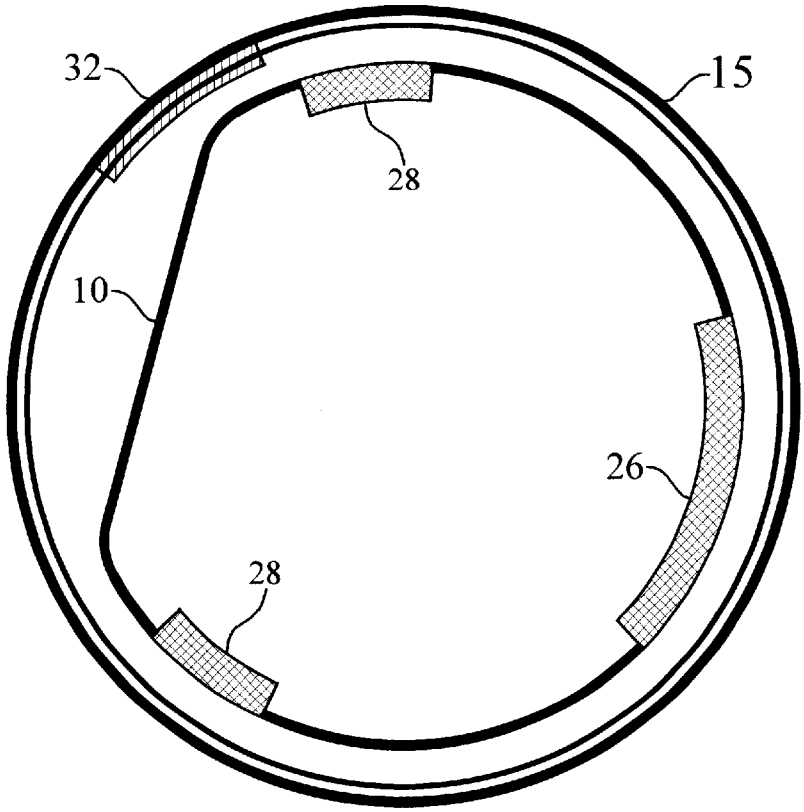
FIG. 5 is a cross sectional view of a fast-moving capsule in a curved pipeline segment.

FIG. 5 is a cross section of a capsule 10 moving at high speed through a curved section of pipe. Capsule movement is assumed to be into the paper, and the pipe is curved to the left. In curving pipe segments the inductive load 32 is positioned toward the inside radius of the curve. This allows the capsule 10 to bank at any angle up to a certain maximum without either of the stabilization pole arrays 28 coming close enough to the inductive load 32 for magnetic attraction to pull them into contact. As shown, the capsule is banking at about 75 degrees, corresponding to a 4-G turn—far more than most payloads would allow.

Figure 6:
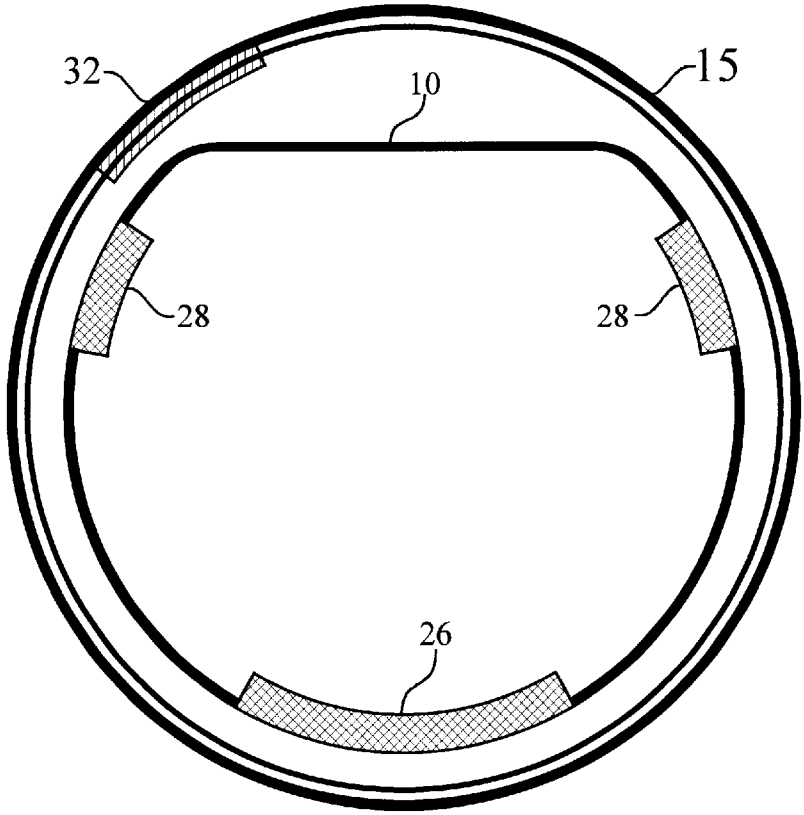
FIG. 6 is a cross sectional view of a slow-moving capsule in a curved pipeline segment.

In FIG. 6 a capsule is moving through the same curve at slow speed, with no bank. Again, neither of the stabilization arrays faces the inductive load. The system design allows each capsule to bank according to its actual speed of passage and does not restrict them to a particular angle of bank determined at the time of construction as in railroads, maglev trains, and nearly all other land-based transportation systems. In the first phase of operation after construction, capsules may be restricted to relatively low speeds. As operational confidence grows the speeds can gradually be increased with capsules always banking the optimal amount to minimize side forces on the payload, and with no changes needed in the pipeline installation.

In a typical capsule pipeline transportation network connecting three cities, for example, the three links could each include two pipelines, one for transport in each direction. If capsule traffic on any link reaches peak capacity or a link must be deactivated for construction, maintenance, or repairs traffic may be rerouted to another path. Alternatively, to minimize capital costs, the network could be constructed as a grid of one-way connections. For example, four cities could be interconnected by four one-way pipelines (plus other connections to the grid), rather than the eight required for two-way operation. If any pipeline is shut down, again traffic is routed along a different path around the grid.

The system corresponds to a packet switching network of the type used for Internet communication, but in this case carries material goods rather than data. The small circumferential dimensions of the pipeline allow it to be installed above ground, at ground level, or underground along existing rights-of-way such as beside railroad tracks, power lines, or highways.

Figure 7A:
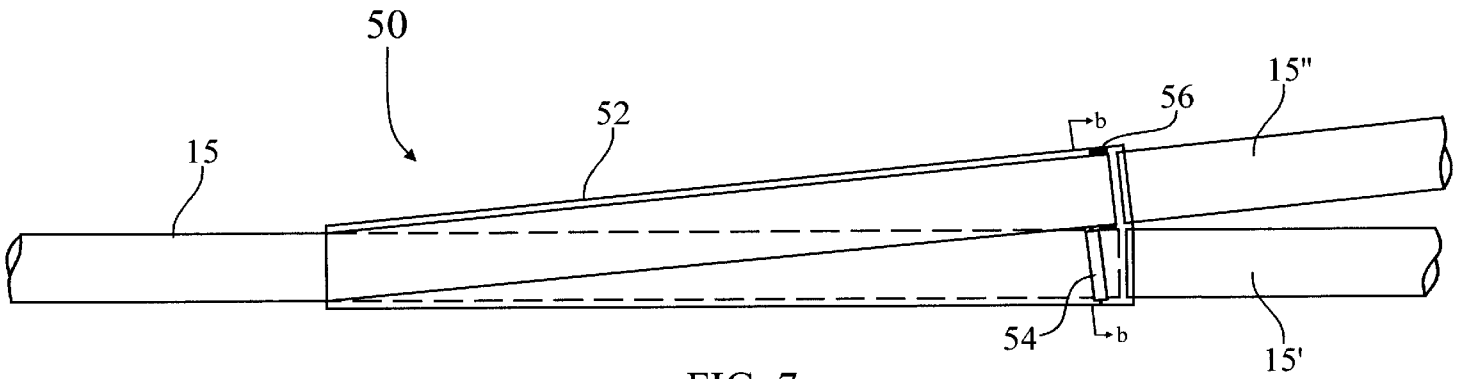
FIG. 7*a* is a side view of a two-way flexing pipeline switch inside a vacuum chamber.

A pipeline network, according to preferred embodiments of the present invention, includes switching segments or routers, which allow the transportation path to be switched between two or more further pipeline segments. FIG. 7*a* shows an example of a 2-way capsule switch 50 designed for a high-speed pipeline segment 15. When switched to the lower pipe 15' (as shown in broken lines), the link is straight to allow maximum speed. To route capsules to a different path the switch segment is moved by actuator 54 to the upper pipeline 15", as shown in solid lines. Actuator 54 may be any suitable mechanism for changing the route of the pipeline. The switch segment 50 is preferably contained by an airtight enclosure 52.

Figure 7B:
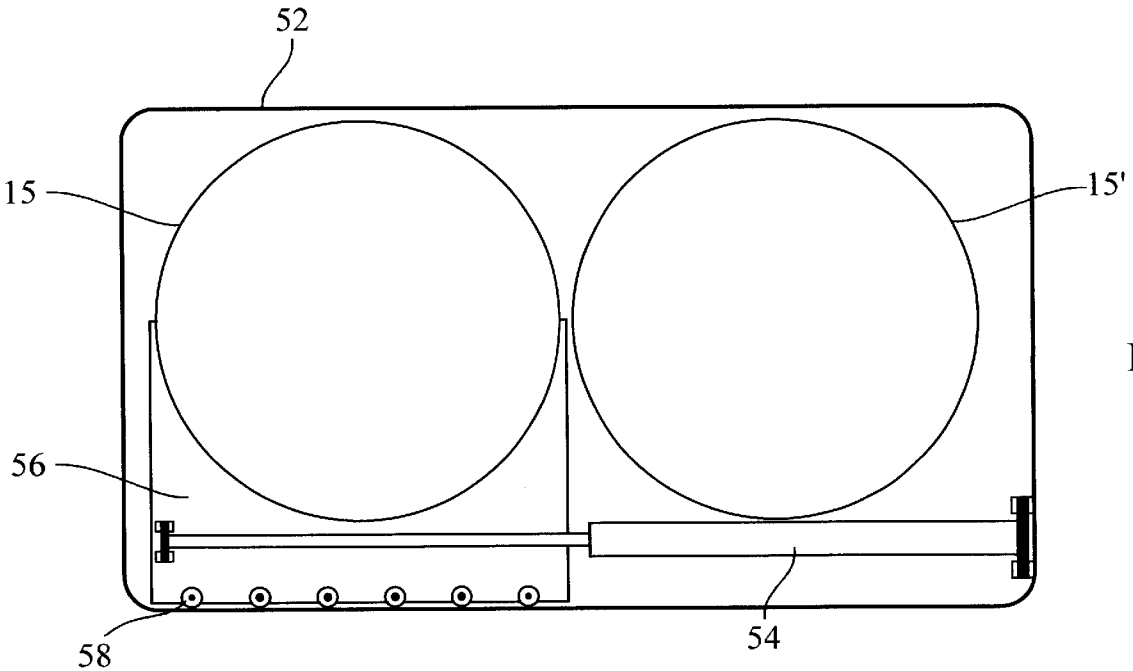
FIG. 7*b* is a front cross-section view, taken along line b—b of FIG. 7*a*.

FIG. 7*b* shows a cross-section of switch 50, taken along line b—b in FIG. 7*a*. Pipeline segment 15 is supported by cradle 56, which moves on rollers 58. Actuator 54 moves cradle 56 between two positions to align pipeline segment 15 either with pipeline 15' or with pipeline 15". By way of example, the actuator 54 in FIG. 7*a* is shown as a telescoping piston structure which may be driven by any suitable drive means (not shown) including, but not limited to a motor, pneumatic pressure, electromagnetic force, or the like, capable of moving (or bending) a moveable pipe segment between the path defined by pipeline 15' and the path defined by pipeline 15". Movement of the switch segment is allowed by hinges or by designing the switch segment with a suitable material and/or structure to bend, forming a smooth curve to allow higher speeds. Note that pipeline segment 15 need not fit tightly against pipeline 15' or 15" to maintain a partial vacuum. Rather, all three pipelines, 15, 15' and 15" are sealed, for example by welding, to airtight enclosure 52.

Figure 8A:
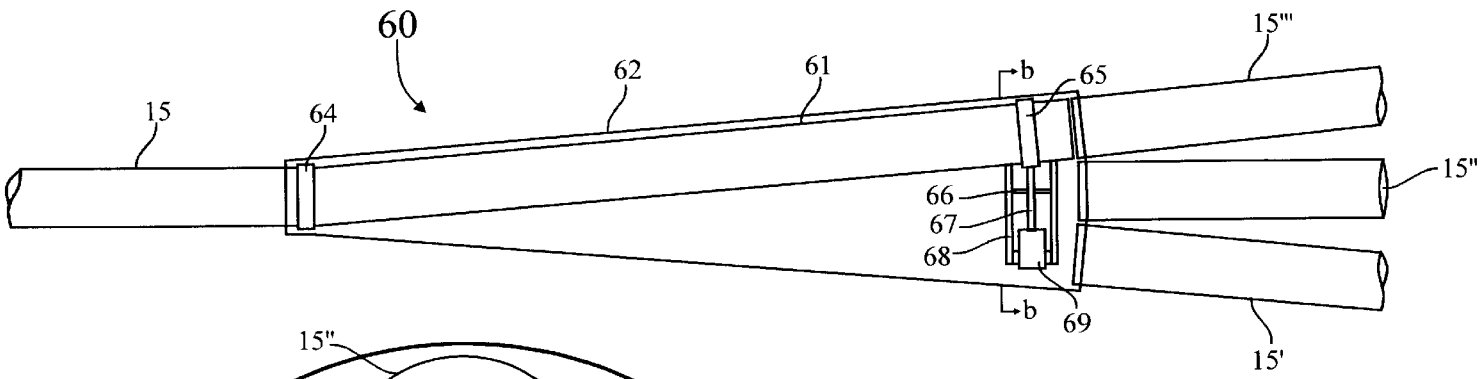
FIG. 8*a* is a top view of a multi-way revolving pipeline switch inside a vacuum chamber.

FIG. 8*a* is a multi-way switch 60, with three of the connector pipelines 15', 15" and 15'" shown. In this embodiment, rather than hinging or bending, the switch segment 61 rotates between the pipeline paths 15', 15" and 15'". Using a similar approach, alignment with 4, 5, or even more pipelines is possible. This is particularly useful at the entry and exit points of a major shipping center with many load/unload stations. This switch is also preferably contained by an airtight enclosure 62, but in other embodiments could be installed in an unsealed pipeline segment.

As with the switch design described with respect to FIGS. 7*a* and 7*b*, rotating pipeline segment 61 need not fit tightly against pipelines 15', 15", or 15'" to maintain a partial vacuum. Rather, all four connecting pipelines 15, 15', 15", and 15'" are sealed, for example by welding, to airtight enclosure 62. Rotating segment 61 is attached to pipeline 15 by bearing 64.

Figure 8B:
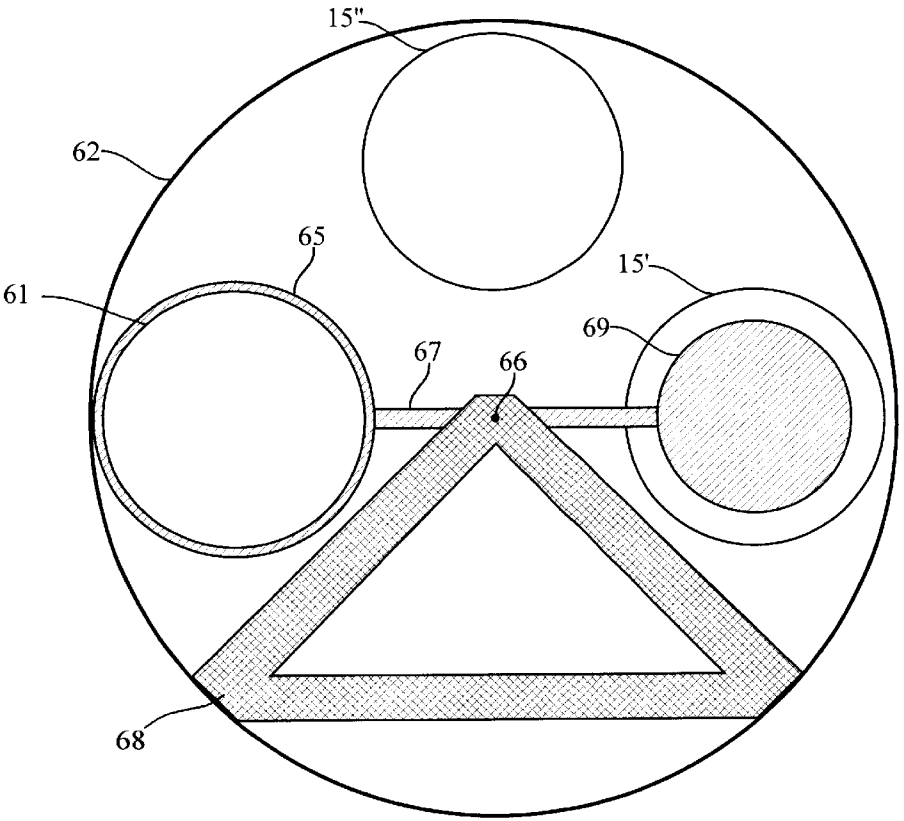
FIG. 8*b* is a front cross-section view, taken along line b—b of FIG. 8*a*.

FIG. 8*b* shows a cross-section of switch 60, taken along line b—b in FIG. 8*a*. Rotating pipe segment 61 is gripped by sleeve 65, which is attached to connecting arm 67. The connecting arm is supported for rotary motion by an axle or pivot 66, which is aligned with the axis of pipeline 15. The axle or pivot 66 is maintained in position by support structure 68. Counterweight 69 is attached to the opposing end of connecting arm 67 and is sized to weigh the same as pipe segment 61, thus facilitating rotary movement of the segment 61 about the axle or pivot 66 with minimum drive force. Rotary drive force may be provided, for example by a suitable drive means (not shown) including, but not limited to a motor, pneumatic pressure, electromagnetic force or the like.

Figure 9A:
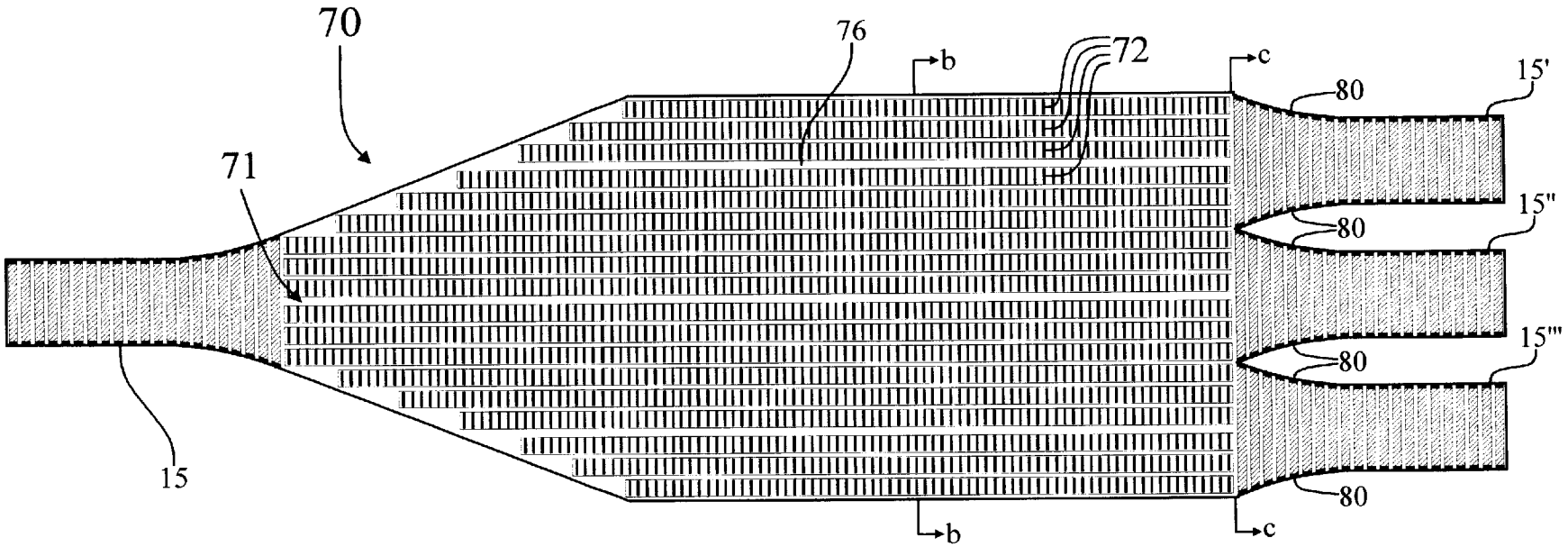
FIG. 9*a* is a top cutaway view of a 3-way capsule router.

FIG. 9*a* is a top cutaway view of an example 3-way capsule router 70 according to another embodiment of the present invention. The router example in FIG. 9 includes a routing chamber 71 designed to direct capsules from a single input pipeline 15 to any of three output pipelines 15', 15" and 15'". The bottom surface of the routing chamber 71 is flat and lined with rows of levitation coils 72 parallel to the pipeline axes. In addition to current induced in the coils by freight capsule magnet arrays, these coils 72 are directly supplied with current by an electronic router controller. Current in each row of coils is individually controlled allowing the lift it provides to a passing capsule to be increased or decreased. By properly configuring the lift profile across the coil rows 72 to create a lift gradient, capsules can be made to "slide downhill", redirecting them from the (central) input pipeline 15 to either the left or right output pipeline. In the absence of a lift gradient, a capsule entering the routing chamber will continue in a straight line and exit through the central output pipeline.

Figure 9B:
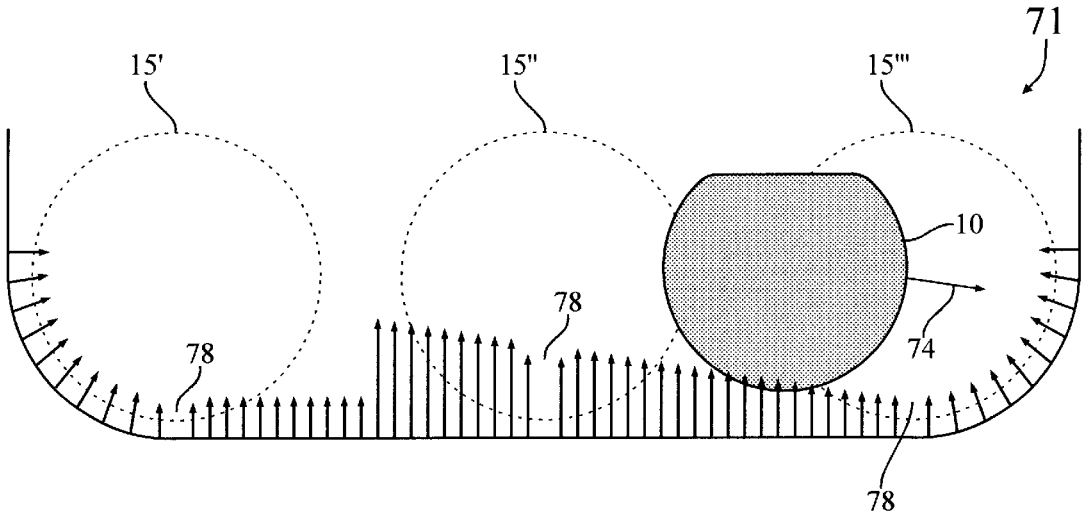
FIG. 9*b* is a front cross-section view, taken along line b—b of FIG. 9*a*, showing vector representations of a lift profile.

FIG. 9*b*, shows a lift profile along a cross-section of the routing chamber 71, taken along line b—b in FIG. 9*a*, wherein the lift gradient (represented by force vectors) decreases in the direction toward the axis of outlet pipeline 15'". Due to the lift gradient, the capsule 10 effectively slides down the slope of the gradient (as shown by arrow 74) and shifts in the direction toward the axis of the pipeline 15'", as the capsule travels along the axial length dimension of the router 70. By similar principles, the lift gradient may be controlled to increase towards the axis of one of the outlet pipelines 15' or 15'", to effectively push the capsule toward the other pipeline axis. Similarly, the lift gradient may be controlled to increase towards the axis of each of the outlet pipelines 15' and 15'", effectively forming a depression channel along the axis of outlet pipeline 15", to help maintain the capsule in the direction toward the outlet pipeline 15".

Preferably, the levitation coils immediately adjacent to each pipeline axis are slightly separated to create a gap 76 providing a "no lift" zone. The "no lift" zone results in a depression 78 in the lift profile along each output pipeline axis, which exerts an automatic centering action on passing capsules. In other embodiments, a "reduced lift" zone may be employed in place of the "no lift" zone, by providing an electromagnetic shield or other suitable means to provide a lower amount of lift along the outlet pipeline axis than on either side of the axis.

Figure 9C:
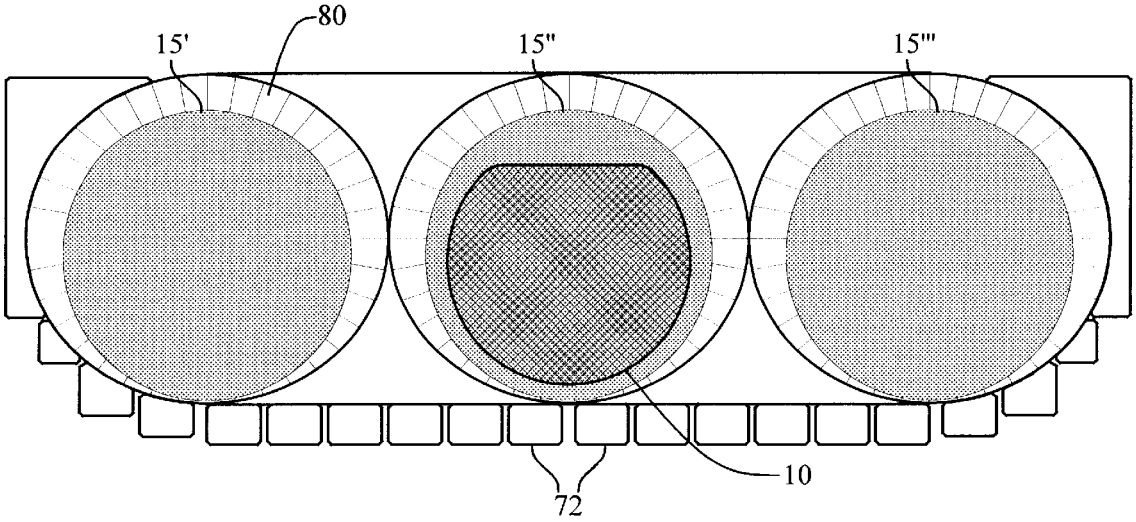
FIG. 9*c* is a front cross-section view, taken along line c—c of FIG. 9*a*.

FIG. 9*c* is an end cutaway view, taken along line c—c of FIG. 9*a*, showing the three output pipelines, with a capsule 10 moving through the center pipeline 15". The router 70 tapers down to meet each of the output pipelines to assist with proper capsule entry into the appropriate pipeline. Levitation coils are included on the curved, tapered sides 80 of the routing chamber to inhibit the capsules from sliding too far to the side and contacting the tapered wall.

The length of the routing chamber 71 is a function of the maximum speed of capsules to be re-routed and the lift profile gradient created by the levitation coils 72. Adequate time must be allowed for a capsule to slide from the axis of the input pipeline to the axis of the desired output pipeline and stabilize for smooth entry into the output pipeline. A routing chamber designed to re-route high speed capsules could be in excess of a hundred feet long.

In the illustrated embodiment, the router has no moving components and no mechanical reconfiguration is required. Routing is entirely electronic, and so may be switched extremely rapidly. Capsules may arrive through the input pipeline a fraction of a second apart and still be dynamically routed to the correct output pipeline, allowing for high throughput. Although the illustrated embodiment has one input and three output pipelines, other embodiments may employ any suitable number of input pipelines and any suitable number of output pipelines, including, but not limited to, one input and two outputs, three inputs and one output, three inputs and three outputs, or the like. For high capsule velocity, the routing chamber and pipelines are generally airtight and partially evacuated. However, other embodiments could be used with unevacuated pipeline segments.

Figure 10:
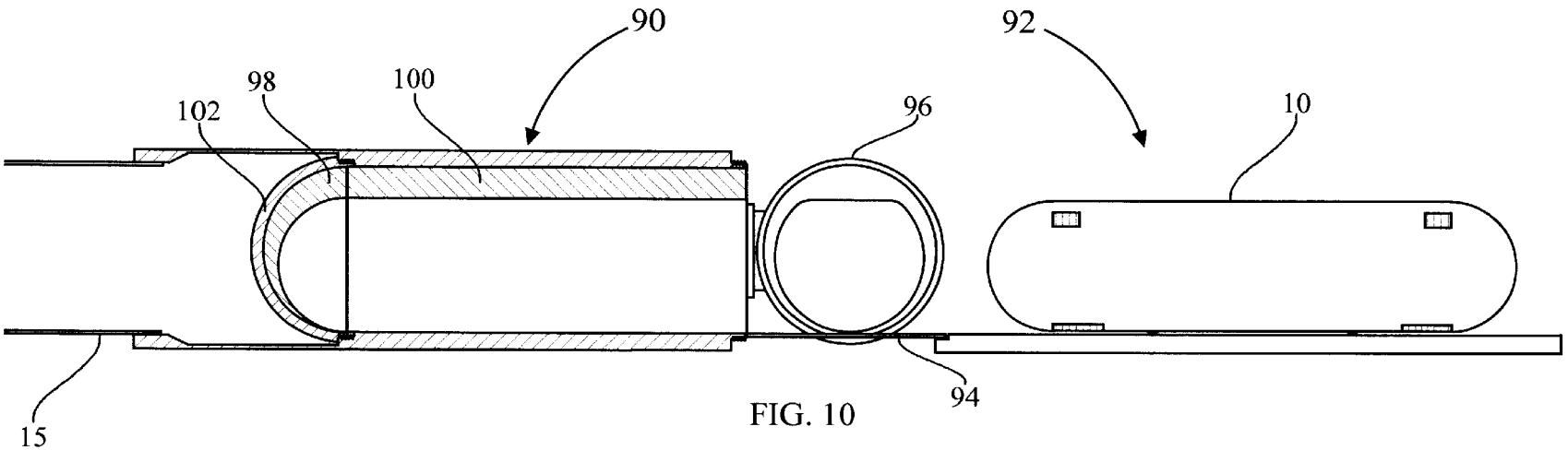
FIG. 10 is a side cutaway view of a pipeline airlock open to a loading room.

FIG. 10 is a side cutaway view of an airlock used in a pipeline freight terminal, in this case with the airlock 90 open to the loading room 92. A freight capsule 10 is wheeled on tracks 94 into the airlock 90, the tracks 94 retract, and the loading room pressure hatch 96 is closed and sealed. The airlock 90 is designed to closely conform to the exterior dimensions of the capsule 10, leaving little airspace, thus minimizing the time required for air evacuation. To better conform to the capsule dimensions, the airlock 90 may include inner doors 98 that fit over the capsule ends and an airlock liner 100 that fills the space above the capsule.

Figure 11:
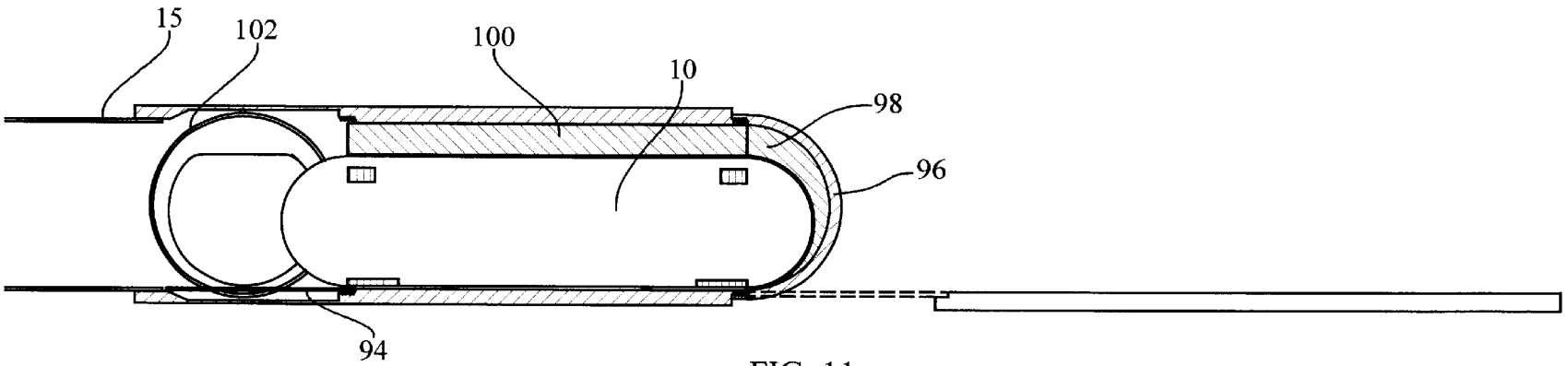
FIG. 11 is a side cutaway view of a pipeline airlock open to the pipeline.

When the airlock has been pumped down to operational pressure by suitable evacuation pumps (not shown) the pipeline pressure hatch 102 is opened and tracks 94 extend, as shown in FIG. 11, and the capsule proceeds on its way. The capsule may be driven into or out of the airlock by any suitable means including, but not limited to a linear electric motor installed in the airlock. In the loading room, the capsule may be moved manually, by a mechanical device, such as a winch or an hydraulic piston, or by a linear motor built into the loading room floor. A freight terminal may have as many airlocks as necessary to support traffic volume. Capsules may be coupled together inside the pipe to allow several of them to be handled as a single unit during shipping. Suitable mechanical, electromagnetic or pneumatic coupling devices may be provided on each end of the capsule 10 for that purpose. Such coupling devices may be controlled by suitable wireless communications devices, to allow operation of coupling and decoupling of capsules, while the capsules are disposed within a pipeline or pipeline component, such as a router. Alternatively, the capsules may be "platooned" and individually controlled as described above.

When a freight capsule arrives at a terminal, it is extracted from the airlock and another capsule departs. If no capsule is ready for freight transport, an empty capsule or a dummy capsule is moved into the airlock instead. The airlock is pumped down and the capsule is moved from the airlock into a pipeline siding designated for capsule storage. In normal operation, the airlock never needs to be pumped down without a capsule inside to displace most of the air and pump down time is minimized.

The above-cited patent to Post (U.S. Pat. No. 5,722,326) describes the force between a pole face and one circuit averaged over a single traverse of the pole face as being approximated by the following equation:

$$F=\lambda/4\pi[(B_0w)^2/L_0]e^{-2ky}\text{Newtons/circuit}$$

where w is the width of a pole face (in meters) and the adjacent circuit and $L_0$ is the inductance of the circuit (in henrys). From this equation, it is apparent that force increases as the square of the circuit width, e.g., if the circuit width is doubled, the force increases by a factor of four. Thus, the repulsive force between the circuits and pole faces used in a capsule pipeline can be maximized by making each circuit as wide as possible. However, the diameter of the pipeline itself sets a relatively small upper limit on the width of each circuit, and in a capsule pipeline many miles long, huge numbers of these circuits are required to provide capsule levitation. Cost minimization makes it desirable to reduce circuit width to substantially less than the pipeline diameter in order to decrease the amount of circuit material used.

Figure 12:
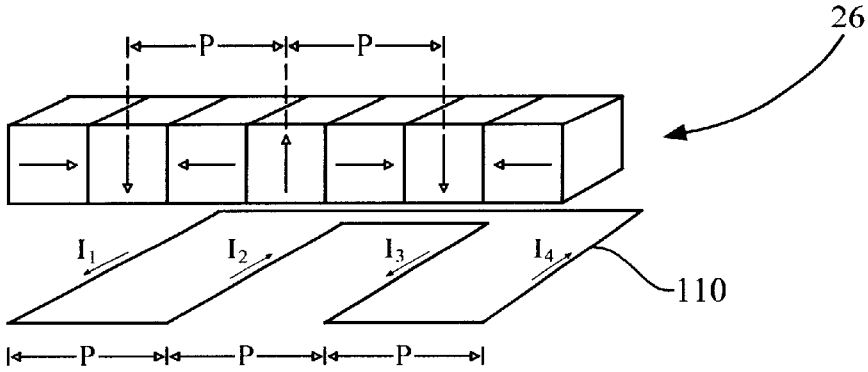
FIG. 12 is a perspective view of a serpentine coil adjacent a moving pole array.

FIGS. 12–17 illustrate a second preferred embodiment of a capsule pipeline and router system that simultaneously accommodates the need for maximum lift and minimum circuit width. Here, the circuit is in the form of a serpentine coil 110, such as shown in FIG. 12. Successive meanders of the coil are separated by distance P. Given a current flow direction (for example counterclockwise), each successive meander defines an oppositely directed current path relative to adjacent meanders, as represented by the opposite directions of the adjacent arrows representing currents $I_1$, $I_2$, $I_3$ and $I_4$.

In the corresponding pole array 26, poles of opposite polarity are also spaced at distance P. As a pole of, for example, negative polarity passes over one meander of the circuit, it induces a current $I_1$, the magnitude of which depends on the magnetic field strength, circuit inductance, resistance, width, etc. At the same time, a pole of positive polarity passes over the successive meander, inducing current $I_2$, which adds to current $I_1$, as does the current in each of the two succeeding meanders. The total current induced in the circuit is $I_1+I_2+I_3+I_4$, i.e., four times the current induced by a single pole face, which is the same as the current that would be induced in a circuit four times as wide.

From the equation above, the total repulsive force is 16 times the force created by a single pole-circuit pair—the same as a single circuit four times as wide. If the number of circuit meanders and pole array elements is increased further, the force increases correspondingly. The total force produced by a circuit of this design having M meanders of width W is equivalent to a single pole and circuit of width M times W. The net result is the ability to create a narrow, low cost levitation system, with very high lift force.

Figure 13:
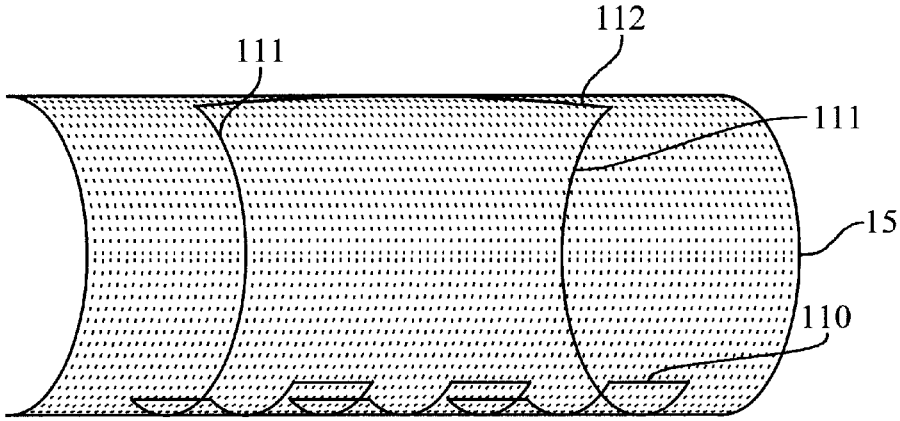
FIG. 13 is a side cut-away view of a pipeline section having a serpentine coil.

FIG. 13 shows a cutaway view of a pipeline 15, with a single serpentine levitation coil 110 on the interior surface. In practice, many identical coils would be installed in an overlapping arrangement. As shown, both ends 111 of each coil 110 extend upward, almost to the top of the pipeline, where they are connected by a linear segment 112, nearly parallel to the pipeline axis. As discussed in the prior art, the lift-to-drag ratio of such pole-circuit designs is proportional to $L_0/R$, so the linear segment may be inductively loaded to improve the lift-to-drag ratio. Accordingly, an inductive load 32 may be provided along the pipe 15, as discussed above, with respect to FIG. 2.

Figure 14:
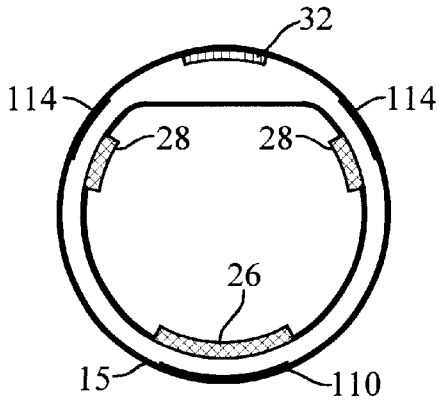
FIG. 14 is a cross section view, taken through the pipeline of FIG. 13 and a freight capsule.

FIG. 14 shows a cross section taken through a pipeline and freight capsule, showing an example placement of the serpentine levitation coil 110, the inductive load 32, and the capsule magnet arrays 26 and 28. Smaller stabilization coils 114 of the same design as the levitation coil are placed on both sides of the pipeline 15, in the upper quadrants, to help maintain the capsule upright and centered. Alternatively, the smaller stabilization coils 114 may be omitted, in which case the stabilization arrays will interact with the upward extending ends 111 of the levitation coils 110 to achieve lateral stability.

Figure 15:
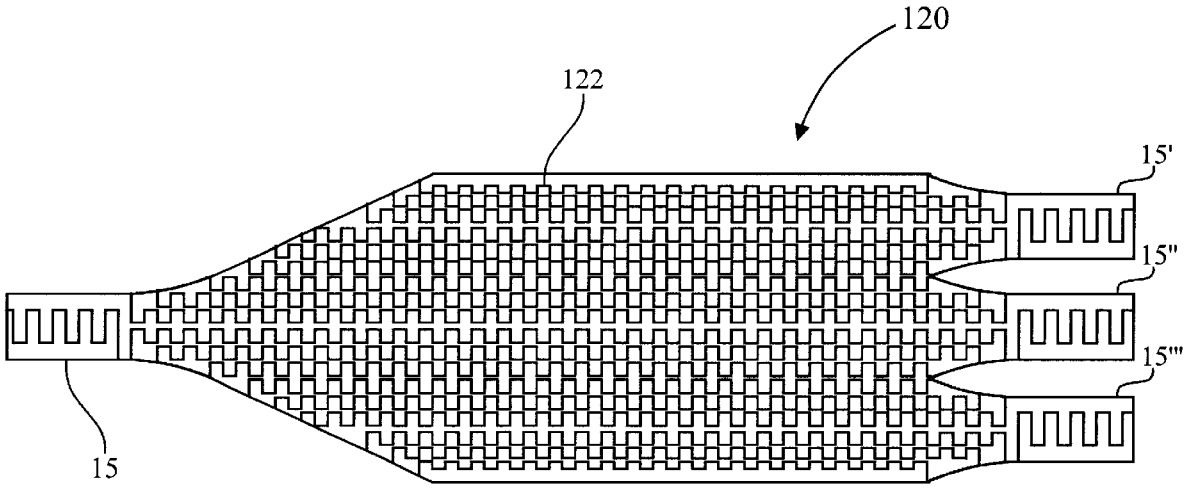
FIG. 15 is a top cutaway view of a 3-way capsule router having serpentine coils.

FIG. 15 is a top cutaway view of a 3-way capsule router 120, similar to that described above with respect to FIGS. 9*a*–9*c*, however configured with serpentine coils. While the router 120 is shown with a single input pipeline and three output pipelines, other embodiments may be similarly configured with any suitable number of input pipelines and output pipelines, such as discussed above with respect to FIGS. 9*a*–9*c*.

Figure 16:
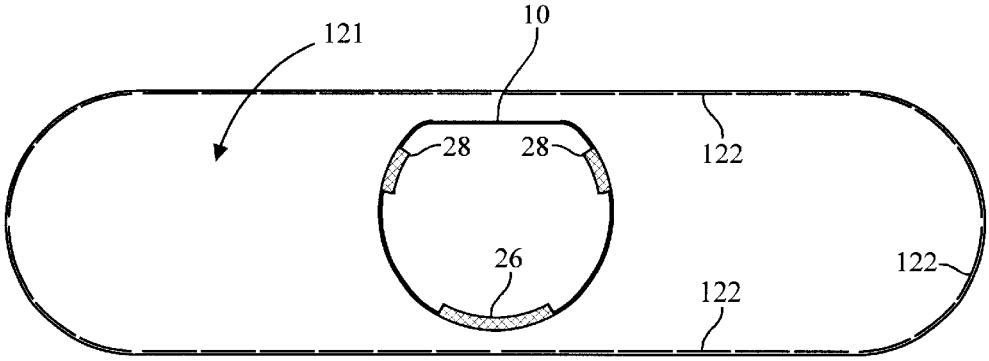

FIG. 16 shows a cross section of the same router, as a capsule 10 passes through. The interior surface of the routing chamber 121 of the router 120 is lined with rows of serpentine repulsion coils 122, parallel to the pipeline axes. Each row includes both passive repulsion coils and powered control coils. Passive coils function as described above, to ensure that rapidly moving capsules encounter adequate levitation and stabilization forces, even if the system loses power. Powered coils are supplied with current by an electronic router controller.

Figure 17:
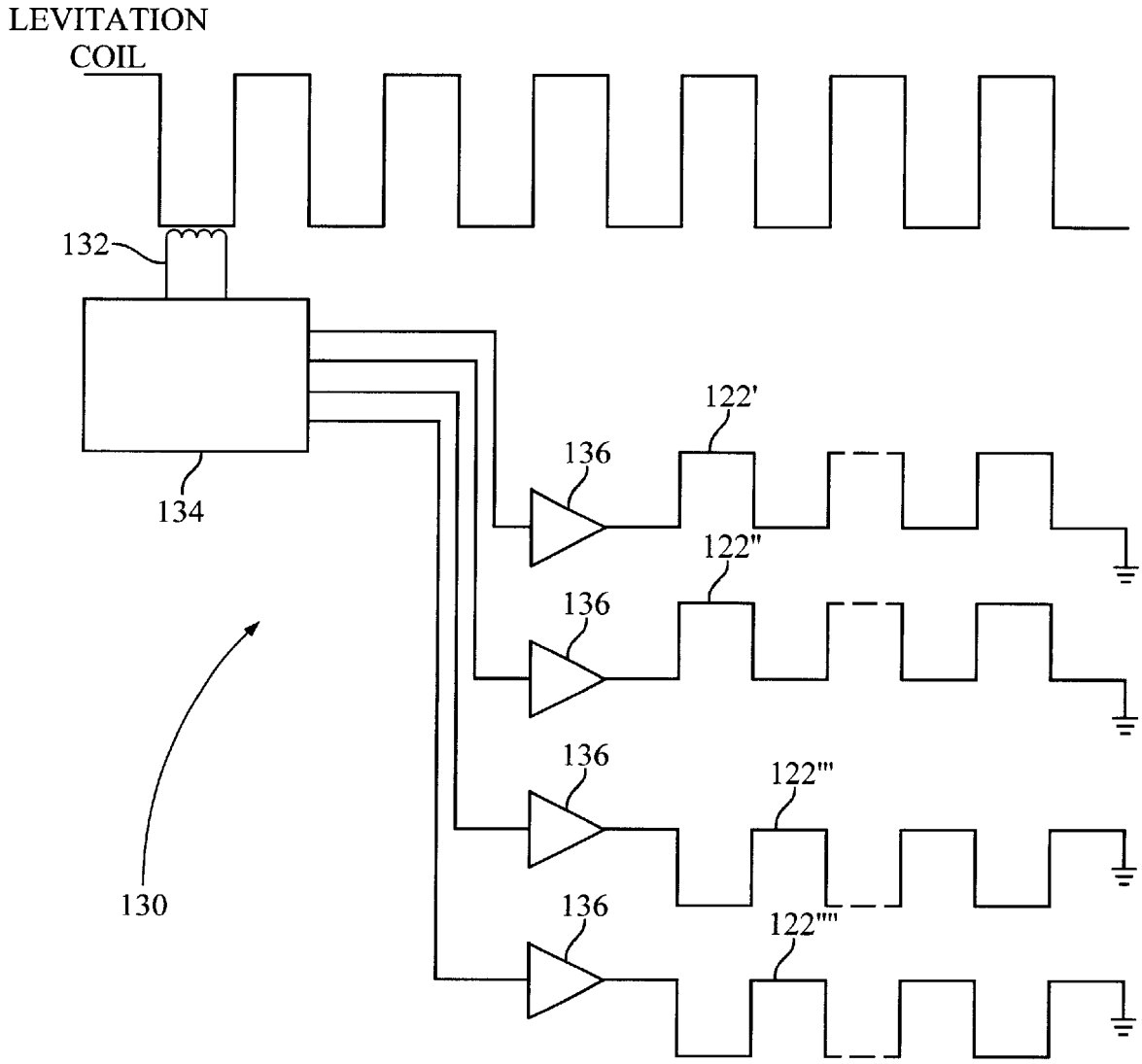
FIG. 17 is a schematic representation of a router controller.

An example of a router controller 130 suitable for the router of FIG. 15, as well as the router of FIGS. 9*a*–9*c*, is depicted in FIG. 17. Current sensors 132 detect the magnitude and phase of current induced by a transiting capsule into passive coils, and provide control electronics 134 with an indication of where the capsule is located in relation to the coil rows. The control electronics 134 supplies current to appropriate drive coils 122', 122", . . . having the phase and amplitude adjusted, for example with suitable amplification circuits 136, to provide both linear and vertical thrust to the capsule. Linear thrust keeps the capsule moving at the desired speed. By properly configuring the vertical thrust profile across both the top and bottom coil rows to create a gradient, capsules can be moved to one side or the other, redirecting them from the central pipeline left or right to the appropriate output pipeline, such as discussed above with respect to FIGS. 9*a*–9*c*. In further embodiments, the serpentine repulsion coils may be replaced with conductive, non-magnetic plates, for example, aluminum. Currents induced in the plates by the magnet arrays on passing capsules will repel the capsule, as do repulsion coils, providing for simpler construction, at the cost of somewhat lower performance and higher power consumption.

Figure 18:
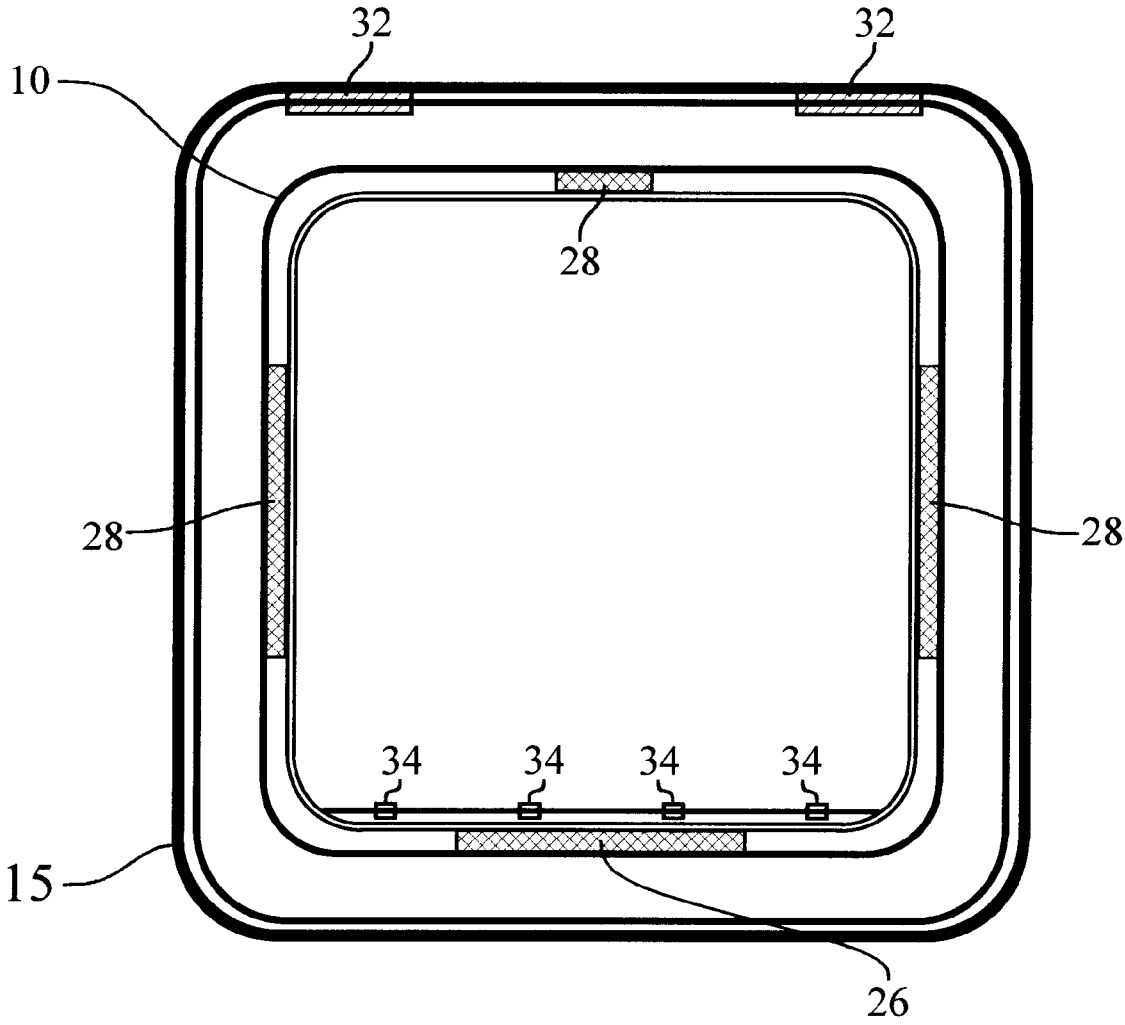
FIG. 18 is a cross section of a freight capsule having a generally rectangular cross-section shape and a pipeline in which it travels.

The foregoing description of the preferred embodiment of the invention has been presented for the purposes of illustration and description. It is not intended to be exhaustive or to limit the invention to the precise form disclosed. Many modifications and variations are possible in light of the above teaching. For example, while the above embodiments are described with reference to pipelines and capsules having generally circular cross-sectional shapes, other embodiments may employ pipelines and capsules having other cross-sectional shapes, such as a generally rectangular or square shape, as shown in FIG. 18. A rectangular design could be used in applications where capsule banking in turns is not necessary and space available is more restricted. Where multiple tubes are required, square or rectangular tubes can be packed more tightly together than circular tubes. Therefore, it is intended that the scope of the invention be limited not by this detailed description, but rather by the claims appended hereto.

What is claimed is:

1. A transportation system comprising:

a pipeline having a generally concave-shaped interior extending along a pipeline axis and provided with an electrically conductive structure that generally conforms to the concave shape of the interior of the pipeline;

a capsule disposed within the pipeline interior and moveable along the axial dimension of the pipeline, the capsule having at least one magnet array positioned to induce current into the electrically conductive structure of the pipeline of sufficient magnitude to levitate the capsule within the pipeline, as the capsule moves through the pipeline; and means for propelling the capsule through the pipeline at a speed sufficient to provide lift force by the interaction of the magnet array on the capsule and the conductive structure of the pipeline, to levitate the capsule within the pipeline.

2. A system as recited in claim 1, wherein said electrically conductive structure of said pipeline comprises a plurality of electrically conductive coils, each coil having a section disposed at least partially circumferentially around the pipeline axis, said plurality of coils being arranged along the axial length dimension of the pipeline.

3. A system as recited in claim 2, wherein said pipeline further comprises an electrical inductive load coupled in electrical communication with the electrically conductive coils.

4. A system as recited in claim 3, wherein said inductive load comprises high-permeability ferrite.

5. A system as recited in claim 3, wherein said inductive load comprises at least one length of magnetically conductive material extending in the axial length dimension of the pipeline.

6. A system as recited in claim 3, wherein said pipeline is disposed with its axial length directed transverse to the vertical direction, such that the pipeline defines a top portion disposed vertically above the capsule, as the capsule is propelled through the pipeline and wherein said inductive load is on the top portion of the pipeline.

7. A system as recited in claim 3, wherein said pipeline includes generally straight sections and curved sections and is disposed with its axial length directed transverse to the vertical direction, such that the pipeline defines a top portion disposed vertically above the capsule, as the capsule is propelled through the pipeline and wherein said inductive load is on the top portion of straight sections of the pipeline and is disposed towards the inside radius of curved sections of the pipeline.

8. A system as recited in claim 1, wherein said electrically conductive structure of said pipeline comprises a plurality of electrically conductive coils extending along the axial length dimension of the pipeline, each coil defining a serpentine path.

9. A system as recited in claim 1, wherein said electrically conductive structure of said pipeline comprises a plurality of electrically conductive sheets extending along the axial length dimension of the pipeline, each separated by a gap.

10. A system as recited in claim 1, further comprising a router having:

an inlet coupled to said pipeline, through which the capsule is propelled from said pipeline;

a plurality of outlets, each coupled to a respective outlet pipeline; and a plurality of electrically conductive structures, each electrically conductive structure arranged in the direction of a respective one of said outlets, for interacting with said magnet array on the capsule, as the capsule is propelled through the router, to provide lift force sufficient to levitate the capsule within the router.

11. A system as recited in claim 10, wherein said plurality of electrically conductive structures on the router comprise a plurality of rows of coils, each row extending toward a respective outlet.

12. A system as recited in claim 10, wherein said router further comprises control electronics for selectively providing current to said plurality of conductive structures on the router, for creating a gradient in the lift force within the router, for controlling movement of the capsule toward a selective one of said outlet pipelines, as the capsule is propelled through the router.

13. A system as recited in claim 1, wherein said electrically conductive structure of said pipeline comprises at least one serpentine, electrically conductive coil.

14. A system as recited in claim 13, wherein:

each serpentine coil comprises a plurality of length sections disposed adjacent each other and transverse to the axial direction of the pipeline, said length sections being spaced apart by a pitch P;

each magnet array on said capsule comprises a plurality of magnets disposed adjacent each other, with the poles of each given magnet in the array directed opposite to the magnet poles located in the array at a distance P to either side of the given magnet; and as the capsule is propelled through the pipeline, each magnet of an array induces a current in a respective one of said length sections, such that the currents induced in a plurality of sections of a given serpentine coil by a plurality of magnets of a given magnet array are added together within said given serpentine coil.

15. A system as recited in claim 1, wherein said capsule further having:

a capsule shell;

a payload bay centrally located within the capsule shell; and a plurality of trim tanks containing a flowable heavy material, for weight balance.

16. A system as recited in claim 15, wherein said capsule further comprises a pliable filler material disposed between said capsule shell and said payload bay.

17. A transportation system as recited in claim 1, further comprising an evacuation system coupled in communication with the pipeline interior for providing at least a partial vacuum within the pipeline.

18. A transportation system as recited in claim 1, wherein the at least one magnet array on the capsule comprises at least one array of permanent magnets.

19. A transportation system as recited in claim 1, wherein the at least one magnet array on the capsule comprises at least one Halbach array.

20. A transportation system as recited in claim 1, wherein said electrically conductive structure of said pipeline comprises a plurality of sheets of electrically condcutive material having a plurality of generally parallel slots.

21. A transportation system as recited in claim 1, wherein said electrically conductive structure comprises a plurality of electrically conductive coils.

22. A system as recited in claim 1, wherein said capsule further having:

a capsule shell;

a payload bay centrally located within the capsule shell; and a plurality of stabilizer arrays of magnets, disposed within the capsule shell, on opposite sides of the payload bay.

23. A method of transporting a capsule within a pipeline having a generally concave-shaped interior extending along the pipeline axis and containing an electrically conductive structure that generally conforms to the concave shape of the interior of the pipeline, the method comprising:

locating at least one magnet array on the capsule in a position to induce current into the electrically conductive structure of the pipeline of sufficient magnitude to levitate the capsule within the pipeline, upon the capsule moving through the pipeline at a sufficient speed; and propelling the capsule through the pipeline at a speed sufficient to provide lift force by the interaction of the magnet array on the capsule and the conductive structure of the pipeline, to levitate the capsule within the pipeline.

24. A method as recited in claim 23, further comprising the step of producing at least a partial vacuum within the pipeline.

25. A method of transporting a capsule, comprising:

providing a pipeline having a generally concave-shaped interior extending along a pipeline axis and provided with an electrically conductive structure that generally conforms to the concave shape of the interior of the pipeline;

locating at least one magnet array on the capsule in a position to induce current into the electrically conductive structure of sufficient magnitude to levitate the capsule within the pipeline, upon the capsule moving through the pipeline at a sufficient speed; and propelling the capsule through the pipeline at a speed sufficient to provide lift force by the interaction of the magnet array on the capsule and the conductive structure of the pipeline, to levitate the capsule within the pipeline.

26. A system as recited in claim 25, wherein said electrically conductive structure comprises a plurality of electrically conductive coils, each coil having a section disposed circumferentially around the pipeline axis, said plurality of coils being arranged along the axial length dimension of the pipeline.

27. A system as recited in claim 25, wherein said electrically conductive structure comprises a plurality of serpentine, electrically conductive coils.

28. A method as recited in claim 25, further comprising the step of producing at least a partial vacuum within the pipeline.

29. A transportation system comprising:

a guideway having an axial dimension and a single concave-shaped guide extending along the axial dimension of the guideway, the guideway provided with an electrically conductive coil structure supported by and generally conforming to the concave shape of the concave-shaped guide;

a vehicle moveable within the concave-shaped guide along the axial dimension of the guideway, the vehicle having at least one magnet array positioned to induce current into the electrically conductive coil structure of the guideway of sufficient magnitude to levitate the vehicle relative to the guideway, as the vehicle moves along the axial dimension of the guideway; and means for propelling the vehicle along the guideway at a speed sufficient to provide lift force by the interaction of the magnet array on the vehicle and the conductive structure of the guideway, to levitate the vehicle relative to the guideway.

30. A transportation system as recited in claim 29, wherein the at least one magnet array on the vehicle comprises at least one array of permanent magnets.

31. A transportation system as recited in claim 29, wherein the at least one magnet array on the vehicle comprises at least one Halbach array.

32. A transportation system as recited in claim 29, wherein the guideway comprises a pipeline having a hollow interior and wherein the vehicle is disposed within the pipeline interior.

33. A transportation system comprising:

a guideway having an interior surface extending along a guideway axis and provided with an electrically conductive coil structure generally conforming to the shape of the interior surface of the guideway;

a vehicle moveable along the axial dimension of the guideway, within the guideway interior, the vehicle having at least one magnet array arranged partially around and concentric with the axis of the guideway, the at least one magnet array positioned to induce current into the electrically conductive coil structure of the guideway of sufficient magnitude to levitate the vehicle relative to the guideway, as the vehicle moves along the guideway axis; and means for propelling the vehicle through the guideway at a speed sufficient to provide lift force by the interaction of the magnet array on the vehicle and the conductive structure of the guideway, to levitate the vehicle within the guideway.

34. A transportation system as recited in claim 33, wherein the vehicle has an axial dimension defining a vehicle axis and wherein the at least one magnet array is also arranged partially around and concentric with the axis of the vehicle.

35. A transportation system as recited in claim 33, wherein the guideway comprises a pipeline having a hollow interior and wherein the vehicle is disposed within the pipeline interior.

36. A method of transporting a vehicle within a guideway that extends along a guideway axis and has an electrically conductive structure, the method comprising the steps of: locating at least one magnet array on the vehicle in a position to induce current into the electrically conductive structure of the guideway of sufficient magnitude to levitate the vehicle relative to the guideway, upon the vehicle moving through the guideway at a sufficient speed; propelling the vehicle along the guideway at a speed sufficient to provide lift force by the interaction of the magnet array on the vehicle and the conductive structure of the guideway, to levitate the vehicle relative to the guideway; and rotating the vehicle at least partially around the axis of the guideway, as the vehicle levitates and moves along the guideway; wherein the guideway includes at least one curved section and wherein rotating the vehicle comprises rotating the vehicle at least partially around the axis of the guideway, toward the outer periphery of the curved section of the guideway, as the vehicle levitates and moves along the curved section of the guideway.

* * * * *